US008840450B2

(12) United States Patent
Watson et al.

(10) Patent No.: US 8,840,450 B2
(45) Date of Patent: Sep. 23, 2014

(54) COIN APPARATUS

(71) Applicant: Money Controls Limited, Royton (GB)

(72) Inventors: Mark J. Watson, Cheshire (GB); Kevin Mulvey, Warrington (GB); Graham R. Jones, Lancashire (GB)

(73) Assignee: Money Controls Limited, Royton Oldham (GB)

( * ) Notice: Subject to any disclaimer, the term of this patent is extended or adjusted under 35 U.S.C. 154(b) by 0 days.

(21) Appl. No.: 14/017,866

(22) Filed: Sep. 4, 2013

(65) Prior Publication Data

US 2014/0008176 A1 Jan. 9, 2014

Related U.S. Application Data

(62) Division of application No. 13/294,542, filed on Nov. 11, 2011, now abandoned.

(30) Foreign Application Priority Data

Nov. 12, 2010 (GB) ..... 1019180.7

(51) Int. Cl.

| | |
|---|---|
| ***G07D 1/00*** | (2006.01) |
| ***G07D 5/04*** | (2006.01) |
| ***G07D 3/16*** | (2006.01) |
| ***G07D 3/14*** | (2006.01) |
| ***G07D 5/02*** | (2006.01) |

(52) U.S. Cl.

CPC .. *G07D 3/14* (2013.01); *G07D 5/04* (2013.01); *G07D 3/16* (2013.01); *G07D 5/02* (2013.01)

USPC ..... 453/56

(58) Field of Classification Search

USPC ..... 453/56, 3, 4, 33, 35, 49, 57; 194/342, 194/343, 350

See application file for complete search history.

(56) References Cited

U.S. PATENT DOCUMENTS

| | | | | |
|---|---|---|---|---|
| 2,286,250 | A | | 6/1942 | Albertoli |
| 5,060,778 | A | * | 10/1991 | Daw ..... 194/317 |
| 5,170,874 | A | | 12/1992 | Abe |
| 5,740,897 | A | | 4/1998 | Gauselmann |
| 5,873,404 | A | | 2/1999 | Luginbuhl et al. |
| 6,039,166 | A | * | 3/2000 | Abe et al. ..... 194/317 |
| 6,039,643 | A | * | 3/2000 | Kurosawa et al. ..... 453/3 |
| 6,579,166 | B2 | | 6/2003 | Abe et al. |
| 6,685,552 | B2 | * | 2/2004 | Nomura ..... 453/33 |
| 2003/0032387 | A1 | | 2/2003 | Abe et al. |
| 2004/0200691 | A1 | | 10/2004 | Geib et al. |
| 2008/0082207 | A1 | | 4/2008 | Sjostrom |

(Continued)

FOREIGN PATENT DOCUMENTS

| | | | |
|---|---|---|---|
| DE | 202005020965 | U1 | 11/2006 |
| EP | 1437697 | A1 | 7/2004 |

(Continued)

OTHER PUBLICATIONS

GB, Search Report for GB1019180.7 dated Mar. 10, 2011.

(Continued)

*Primary Examiner* — Mark Beauchaine

(74) *Attorney, Agent, or Firm* — Orrick Herrington & Sutcliffe, LLP

(57) ABSTRACT

A coin sensing unit having a rotary sweeping arm is used to determine characteristics of the coins so that the coins can be deposited in a correct one of the hoppers.

28 Claims, 14 Drawing Sheets

(56) References Cited

U.S. PATENT DOCUMENTS

| | | | |
|---|---|---|---|
| 2008/0087521 | A1 | 4/2008 | Cole |
| 2009/0051103 | A1 | 2/2009 | Aas et al. |

FOREIGN PATENT DOCUMENTS

| | | | |
|---|---|---|---|
| EP | 1679667 | A1 | 7/2006 |
| JP | 03245287 | A | 10/1991 |
| JP | 2002319056 | A | 10/2002 |
| JP | 2009043180 | A | 2/2009 |
| JP | 2009163298 | A | 7/2009 |

OTHER PUBLICATIONS

GB, Search Report for GB1019180.7 dated Jul. 29, 2011.

* cited by examiner

COIN APPARATUS

RELATED APPLICATION

The present invention is a divisional application that claims the benefit of and priority to U.S. patent application Ser. No. 13/294,542, filed Nov. 11, 2011 which claims all rights of priority to Great Britain Application No. 1019180.7 filed on Nov. 12, 2010, which is hereby incorporated by reference.

FIELD

The present invention relates to a coin apparatus.

BACKGROUND

Automated coin accepting and dispensing equipment is required in a wide variety of machines, particularly those which are designed to be operated directly by a consumer. For example, coin accepting and dispensing equipment is required in the user operated, self-service payment systems used in retail outlets such as supermarkets. Other examples of machines in which the equipment is required include vending machines from which consumer products can be purchased and various types of gaming machines which allow a user to play a game in exchange for a fixed monetary sum.

A problem with current coin accepting and dispensing equipment is that inserted coins are singulated in a slow singulating system and fed to a gravity propelled coin acceptor. Acceptable coins are allowed to fall under gravity along an accept path to a coin sorter, where they are sorted according to denomination. From the sorter, the coins are directed, again under the influence of gravity, into coin hoppers, coin storage or along a reject path. The coins therefore lose considerable height both in the coin acceptor and in the coin sorting process, meaning that the coin output is located significantly below the coin input. This can be inconvenient, particularly for users whose physical constraints means that they may have a limited ability to input coins at one location and receive change or credit at a second, lower location. It also requires a significant amount of vertical space, which can be at a premium in retail environments.

It is therefore desirable that the vertical distance between the coin inlet and outlet is reduced to provide improved ease-of-use and to allow a corresponding reduction in the height of the equipment. Another preferable feature of the accepting and dispensing equipment is that the speed at which the equipment is able to process a transaction should be improved over previous systems. The time between coins being inserted by a consumer and coins being dispensed as change or credit following completion of the transaction should be as short as possible in order to avoid delays. This is particularly important where a queue of consumers are waiting to use the equipment, as is often the case in a supermarket or other retail environment.

It is desirable that the automated coin accepting and dispensing equipment can accept and dispense as many different denominations and types of coins as possible. It is also preferable that the equipment has a self-contained character such that it can operate independently. This generally requires the equipment to have a large coin storage capacity to allow it to operate for long periods without requiring a frequent emptying/re-filling of coins by a service person.

However, the size and nature of the machines in which the accepting and dispensing equipment is located can be such that the equipment must fit into a relatively small space in the machine. In a retail or casino environment, where floor space is limited, the footprint of the machine is a key parameter and is kept as low as possible in order to increase the number of machines that can be installed in a defined area of floor. This is similar to the height considerations already discussed. The result has often been to compromise one or more of the objectives set out above. For example, in order to provide accepting and dispensing equipment which has a footprint suitable for use in modern retail machines, the number of coin types which can be accepted by the equipment has been limited. Additionally or alternatively, the size of the coin storage or hoppers has been reduced meaning that the equipment requires a more regular emptying by a service person.

It would therefore be desirable to provide a more compact solution than has been available previously. This would provide a direct and measurable benefit for the operator.

SUMMARY

According to a first aspect of the invention, there is provided an apparatus comprising a motorized coin conveyer configured to convey coins along a substantially curved portion of a guide and a resilient member configured to urge the coin conveyor and the curved portion of the guide together.

The motorized conveyor may comprise a chain of coin conveying elements configured to convey coins along the substantially curved portion of the guide.

The chain may comprise the resilient member and the resilient member may be configured to urge the chain towards the curved portion of the guide.

The resilient member may be configured to urge the guide towards the chain.

The coin conveying elements may comprise upstanding projections from a series of connected segments of the conveyor.

Each projection may be a part of a coin receptacle configured to receive coins of different diameters and push the coins along the curved portion of the guide.

The conveyor may be configured to convey coins from a first lower position to a second upper position along the substantially curved portion.

The chain of coin conveying elements may be configured to receive coins at the first position on an upper side of the chain and to convey the coins along the curved portion until the coins are disposed on a lower side of the chain between the chain and the guide.

The resilient member may be configured to cause the coin conveying elements to continuously urge the coins against the guide to increase the retarding force on the coins when the conveyor is stopped.

The guide may be static relative to the conveyor.

The resilient member may comprise a leaf spring or an elastic member.

The resilient member may be coupled between at least two coin conveying elements.

The resilient member may be integrated into the chain of coin conveying elements.

The conveyor may comprise an endless loop.

According to a second aspect of the invention, there is provided a coin sensing unit comprising: a substantially horizontal main face upon which coins can be deposited; a coin sweeping arm configured to rotate in a plane substantially parallel to a plane of the main face so as to sweep coins across the main face from a coin entry position to a coin exit; and a coin sensing apparatus configured to sense characteristics of a coin as it is swept across the main face.

A rotary centre of the sweeping arm may be located above the main face.

The main face may be substantially circular and the length of the sweeping arm may be substantially equal to the radius of the main face.

A leading face of the sweeping arm may comprise a "V" profile in which coins are held in a fixed position relative to the sweeping arm and thus swept across the main face along a predictable path.

The sensing unit may be configured to cause a comparison between sensed characteristics of the coin and known genuine coin characteristics in order to validate the coin.

The coin exit may be configured to feed coins to a coin conveyor configured to convey coins in a plane substantially parallel to the substantially horizontal plane of the main face of the coin sensing unit.

The coin conveyor may be configured to receive coins from the coin sensing unit and to convey the coins to one of a plurality of coin hoppers.

The coin conveyor may comprise a disc or ring configured to rotate during operation of the unit, or an endless loop chain of coin conveying elements.

The coin conveyor may comprise a series of gates which are configured to open in response to an opening signal to cause at least one coin being conveyed on the conveyor to fall into a selected one of the plurality of coin hoppers.

Each gate may be connected to at least one hopper and the gate which is opened for each particular coin may be selected in response to a signal indicating the sensed coin characteristics thereby causing the coin to fall into the hopper connected to the opened gate.

A solenoid may be located adjacent to each gate to cause the gate to open or close in response to an opening or closing signal.

According to a third aspect of the invention, there is provided a coin apparatus comprising: a coin sensing unit having a substantially horizontal main face upon which coins can be deposited, a coin sweeping arm configured to rotate in a plane substantially parallel to a plane of the main face so as to sweep coins across the main face from a coin entry position to a coin exit and a coin sensing apparatus configured to sense characteristics of a coin as it is swept across the main face; and a coin conveyor configured to receive coins from the coin exit of the coin sensing unit and to convey the coins in a plane substantially parallel to the substantially horizontal plane of the main face of the coin sensing unit.

According to a fourth aspect of the invention, there is provided a coin apparatus for mounting in a gaming or vending or self-operated payment machine, comprising: at least one coin hopper having a first normal position; at least one other component having a first normal position corresponding to the first normal position of the coin hopper; and a slider mountable to the machine for sliding the at least one coin hopper and the at least one other component out of the gaming or vending machine to a second outward position; wherein the at least one coin hopper can be slid independently of the at least one other component.

The coin apparatus may comprise: a sensor for sensing the weight of the at least one coin hopper; and a lock configured to prevent the at least one coin hopper from leaving the first normal position when the at least one other component is not in its first normal position if the weight of the at least one hopper exceeds a predetermined value.

The lock may be configured to prevent the at least one other component from leaving the first normal position when the at least one coin hopper is not in its first normal position if the weight of the at least one hopper exceeds a predetermined value.

The at least one coin hopper and the at least one other component may be mounted on separate sliding rails.

The at least one other component may comprise a housing in which the at least one coin hopper is located in the first position during normal operation of the apparatus in the machine.

According to a fifth aspect of the invention, there is provided a coin apparatus comprising: a first rotary coin conveyor in a substantially vertical plane configured to convey coins from a first lower position to a second higher position; a coin sensing unit configured to receive coins from the first coin conveyor at the second higher position; and a second rotary coin conveyor in a substantially horizontal plane configured to receive coins from the coin sensing unit and to convey the coins to one of a plurality of coin hoppers located beneath the second coin conveyor.

According to a sixth aspect of the invention, there is provided a coin apparatus comprising: a coin singulator in a substantially horizontal plane configured to convey receive and singulate coins; a coin sensing unit in a substantially horizontal plane configured to receive coins from the coin singulator; and a rotary coin conveyor in a substantially horizontal plane configured to receive coins from the coin sensing unit and to convey the coins to one of a plurality of coin hoppers located beneath the coin conveyor.

The horizontal planes of the coin singulator, coin sensing unit and coin conveyor may be at substantially the same vertical height.

BRIEF DESCRIPTION OF THE FIGURES

For the purposes of example only, embodiments of the invention are described below with reference to accompanying figures in which.

DETAILED DESCRIPTION

Embodiments of an improved coin accepting and dispensing unit, in which various aspects of the unit individually represent an advance over previous equipment, are described below. In particular, the unit may comprise three principal sections; a coin singulating apparatus, a coin acceptor apparatus and a coin sorting and distributing apparatus. In this regard, a fast coin singulating apparatus, a substantially horizontal, powered coin acceptor and a substantially horizontal, intelligent coin sorting and distributing apparatus are all described. The coin singulating apparatus may feed the coin acceptor, which in turn may feed the coin sorting and distributing apparatus.

Figure 1A:
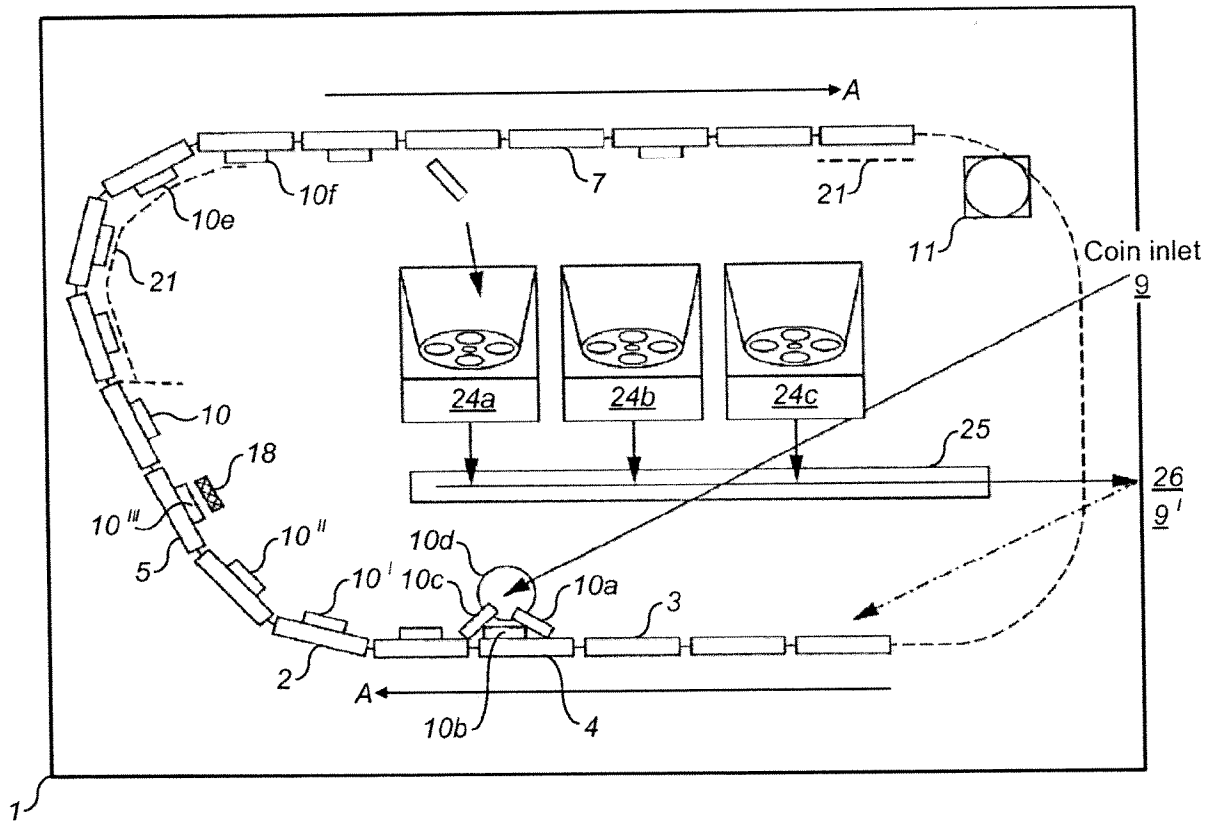
FIG. 1A is a schematic illustration of an endless loop coin conveyor comprising a plurality of coin conveying elements linked in a chain.

Referring to FIG. 1A, a coin accepting and dispensing unit has a housing 1 containing a first endless loop conveyor 2 in a substantially vertical plane. The conveyor 2 forms part of the coin singulating apparatus referred above and is made up of multiple segments 3. As explained below, each segment 3 comprises a coin conveying element and is adapted for conveying one or more coins from a first, lower position to a second, higher position in the housing 1. The segments 3 are connected together to form a flexible chain in a manner described further below. The conveyor 2 includes a coin receiving portion 4 and an ascending portion 5 that extends from the coin receiving portion 4 towards an upper location in the housing 1. An overarching portion 7 of the conveyor 2 extends from the top of the ascending portion 5 to a descending portion 8, which descends back to the coin receiving portion 4 and thereby completes the loop. In order to simplify FIG. 1A, segments 3 on the conveyor 2 have been omitted from the descending portion 8. Instead, the path of the conveyor 2 in the descending portion 8 is shown in dotted outline.

Figure 2:
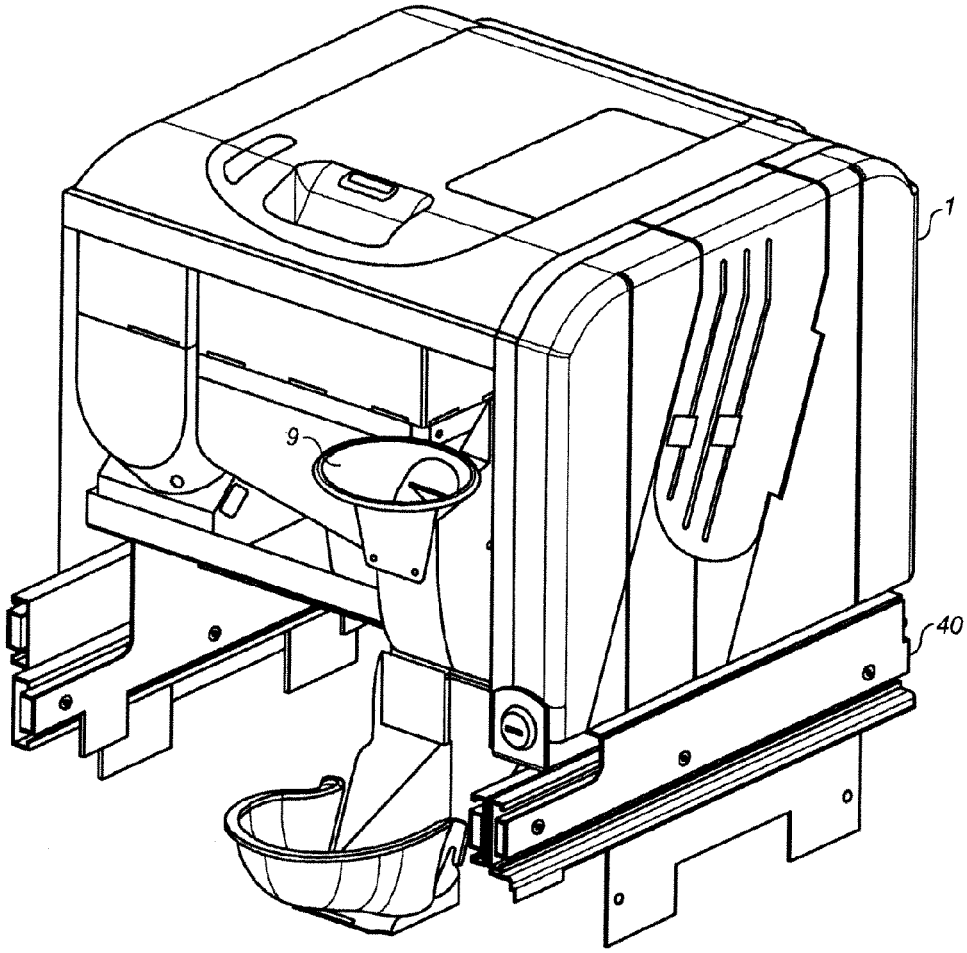
FIG. 2 is perspective illustration of the exterior of a housing of a coin accepting and dispensing unit containing the endless loop conveyor.
Figure 5:
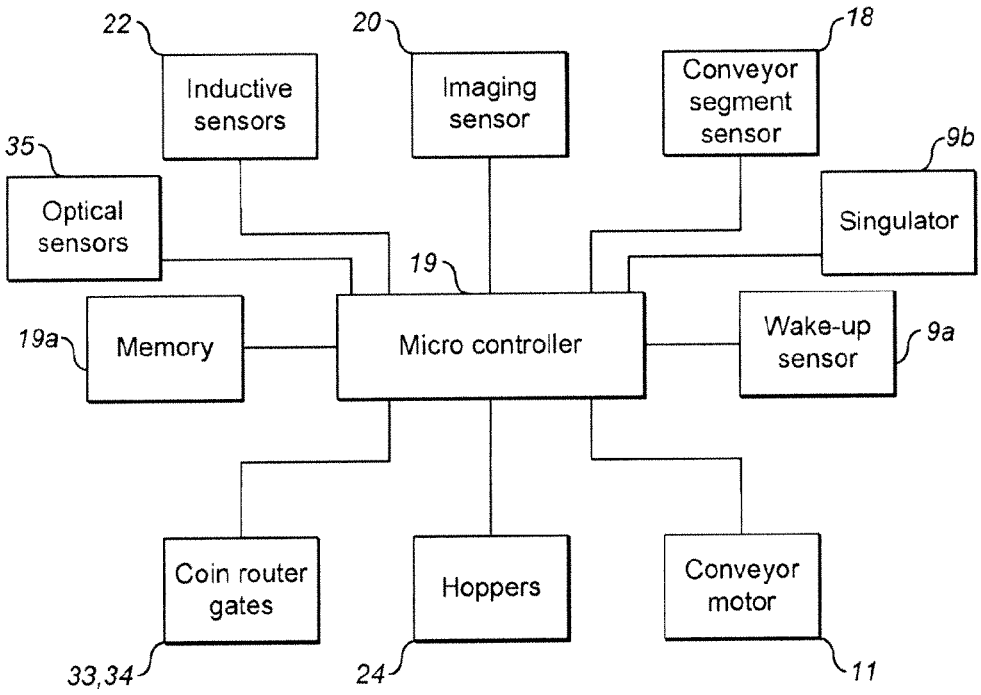
FIG. 5 is a schematic illustration of communicative couplings between a microcontroller and other elements of a coin accepting and dispensing unit.

In order to perform a transaction, a user may insert a coin through a coin inlet 9 in the housing 1 to be received on the coin receiving portion 4 of the conveyor 2. The exterior of the housing 1 and the coin inlet 9 is shown in FIG. 2. In practice, the user may deposit a plurality of coins through the inlet 9 contemporaneously. The coins may enter the inlet 9 either together or rapidly one after the other. If the accepting and dispensing unit is not connected to a power supply or is powered off for some other reason, the coins inserted through the inlet 9 are immediately returned to the user via a return shoot (not shown). However, if the accepting and dispensing unit is powered on, the coins inserted though the inlet 9 are diverted from the inlet 9 to a wake-up sensor 9*a* positioned adjacent to the coin inlet 9. The wake-up sensor 9*a* may be configured to sense the coins and, in response, send a wake-up signal to a microprocessor 19 of the accepting and dispensing unit. The microprocessor can be in the form of a microcontroller 19 and is illustrated in FIG. 5. Upon receiving a signal from the sensor 9*a*, the microcontroller 19 may in turn cause a power-saving mode of the unit to be de-activated so that the accepting and dispensing unit is ready to accept and dispense coins. The power-saving mode may, for example, have been activated automatically by the microcontroller 19 in response to a relatively long period of inactivity in the unit.

Having passed the wake-up sensor 9*a*, the coins may be received at a coin singulator 9*b*, which is comprised, along with the conveyor 2, in the overall coin singulator apparatus referred to above. The singulator 9*b* separates the coins into an ordered, single file row and causes them to be deposited on individual segments 3 of the conveyor 2 such that each coin is spaced from the preceding coin, with one of its major surfaces lying on a respective one of the conveyor segments 3.

Figure 1B:
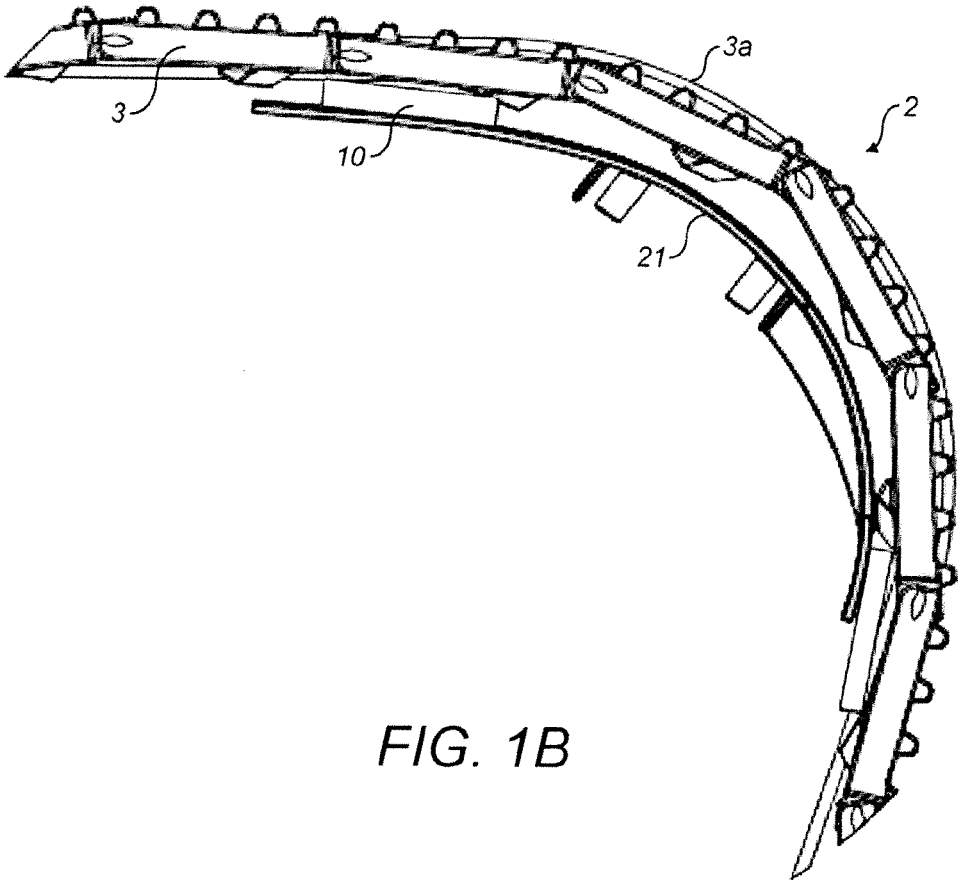
FIG. 1B is an illustration of a part of the chain of coin conveying elements being urged towards a guide plate by a resilient means connecting the elements together.
Figure 7A:
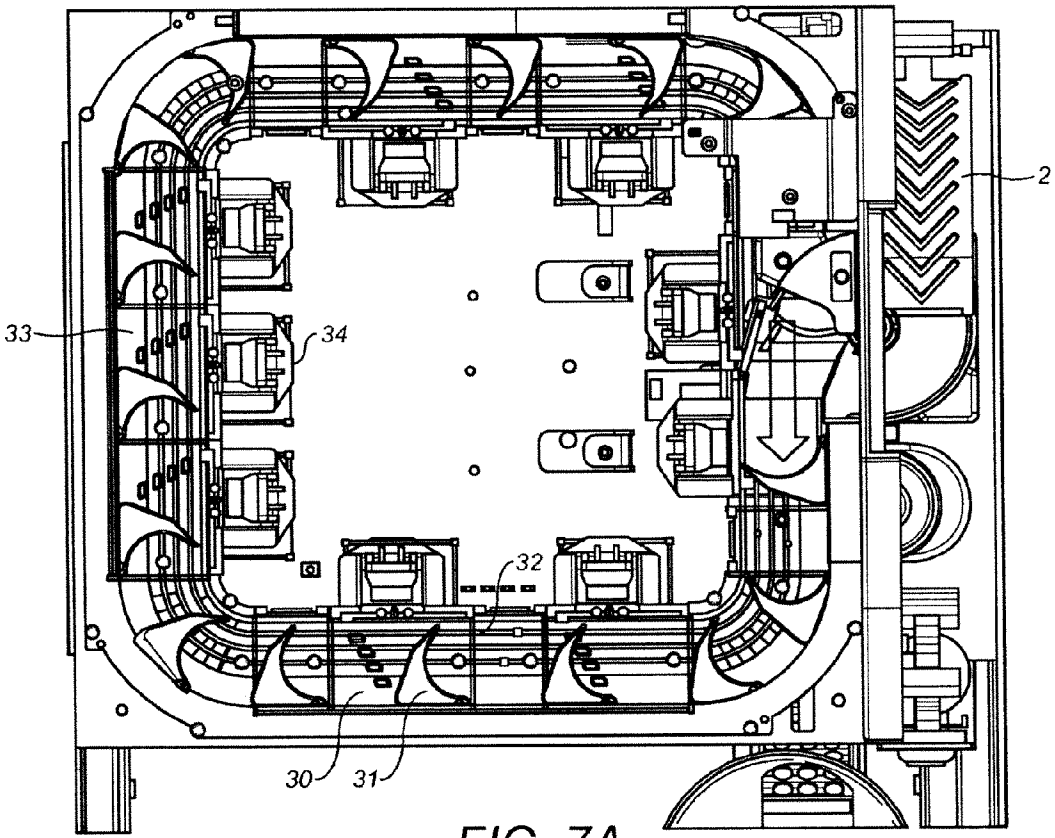
FIG. 7A is a plan illustration of a carousel conveyor for conveying coins in a substantially horizontal plane from a coin accepting unit to coin storage.

For example, as shown in FIG. 1A, a bunched arrangement of coins 10*a*-10*d* may be received at the singulator 9*b* and passed to the coin receiving portion 4 of the conveyor 2. The conveyor 2 is driven by a motor 11 in a clockwise direction, as shown by arrows A, so that as the segments 3 of the conveyor 2 move through the coin receiving portion 4, each segment 3 receives an individual coin 10', 10", 10'" etc that move in an ordered sequence, segment by segment, along the ascending portion 5 of the conveyor 2. It will be understood that the direction in which the conveyor 2 moves could alternatively be anticlockwise, as shown in FIG. 1B and FIG. 7A.

Figure 3:
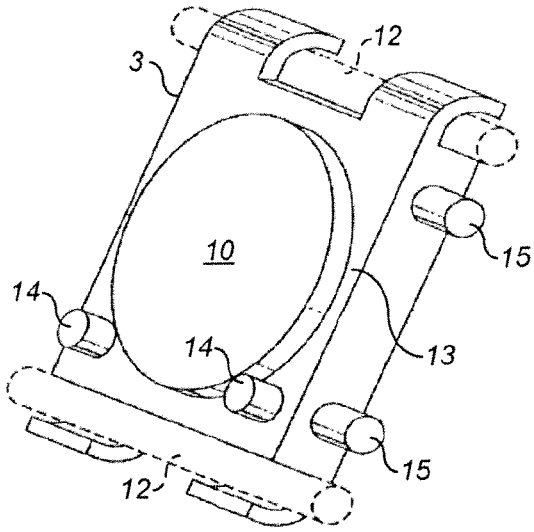
FIGS. 3 and 4 illustrate an example of a segment of a coin conveyor.
Figure 4:
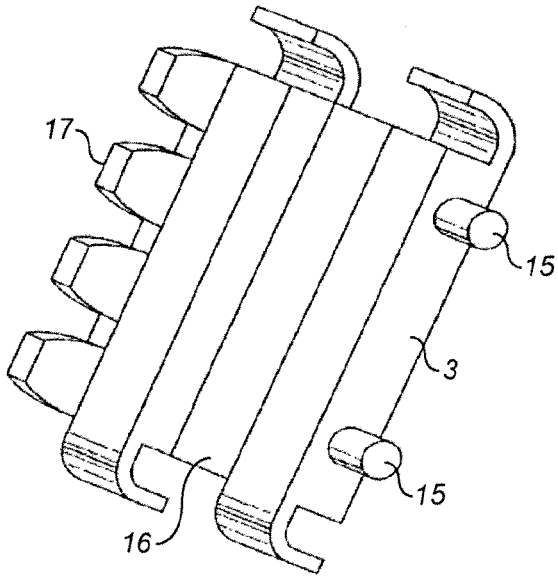

An example of an individual one of the segments 3 is illustrated in more detail in FIGS. 3 and 4. Adjacent segments 3 are connected together by means of pivot pins 12 shown in dotted outline. Each conveyor segment 3 has a main surface 13 that receives an individual coin 10 as shown in dotted outline. The coin 10 is received in a receptacle defined by upstanding coin conveying lugs 14 that can receive coins of different diameters and hence different denominations so as to be disposed symmetrically about the longitudinal centre-line of the conveyor, with the major surface of the coin lying on the main surface 13 of the conveyor. Lateral guide lugs 15 are provided on opposite sides of the segment 3 to be received in grooves (not shown) that guide passage of the conveyor 2 within the housing 1. As illustrated in FIG. 4, the underside of the conveyor segment 3 has a longitudinally extending recessed portion 16 that allows inductive sensors to be placed in close proximity with the coin if required. The motor 11 shown in FIG. 1A is provided with a toothed gear that engages with a rack gear 17 that extends along the length of the conveyor. The individual conveyor segments 3 may be moulded in a rigid plastics material to facilitate inductive coupling between the coins and sensors in the acceptor. Also, the individual segments 3 of the conveyor 2 may be provided with an individual code, for example a magnetic code. Alternative coding arrangements will be evident to those skilled in the art, for example RFID or optical bar-coding.

Referring again to FIG. 1A, as the conveyor segments 3 move along the ascending portion 5, they may pass a magnetic detector 18 that detects the individual code associated with each segment 3 of the conveyor as it passes the detector 18. Data from the detector 18 is fed to the microcontroller 19 referred to above, enabling to microcontroller 19 to closely monitor rotation of the conveyor 2 and the individual location of each segment 3.

From the ascending portion 5 of the conveyor 2, the coin carrying segments 3 turn through an angle, for example in excess of ninety degrees, so as to pass along the overarching portion 7 of the conveyor 2. As a result, the coins 10 become disposed on the underside of the corresponding segments 3. For example, in FIG. 1A, the coin 10*e* is on the underside of the conveyor segment 3. In order to prevent the coins 10 from falling from their receptacles on the conveyor segments 3 in the ascending 5 and overarching 7 portions of the conveyor 2, a guide plate 21 illustrated in dotted outline is provided on the underside of the conveyor 2 in at least part of the overarching portion 7, and on the inside of the conveyor 2 in at least part of the ascending portion 5.

The apparatus may comprise a resilient member such as an elastic or sprung member which is configured to urge the conveyor 2 and the guide 21 together. In particular, the resilient member may be configured to urge the conveyor 2 and the guide 21 together as the conveyor 2 moves between the ascending and overarching portions 5, 7.

Referring to FIG. 1B, a resilient means 3*a*, for example comprising an elastic member or a sprung member such as a leaf spring 3*a* or an elastic belt 3*a*, may be attached to or incorporated into the chain of conveyor segments 3 to connect the segments 3 together. It will be appreciated that the conveyor 2 illustrated in FIG. 1B is slightly different in configuration to that shown in FIG. 1A because it is adapted to rotate in an opposite direction to that shown in FIG. 1A. The coins are lifted in an anti-clockwise direction, rather than the clockwise direction shown in FIG. 1A. Nevertheless, the same principles apply to both Figures.

Either one or a plurality of connected resilient means 3*a* may extend around the entire endless loop so that all segments 3 are connected together by the resilient means 3*a*. The resilient means 3*a* causes the segments 3 to be urged towards the guide plate 21 as the segments 3 travel around the curved path of the conveyor 2, for example as they ascend and cross the overarching portion of the conveyor 2. One way in which this may be achieved is for the resilient means 3*a* to urge each of the individual segments 3 directly towards its neighbouring segments 3, thereby causing the segments 3 to be urged towards the guide plate 21 when stretched around the curved path of the conveyor 2.

The resilient member 3*a* may alternatively be configured to urge the guide 21 towards the conveyor 2. For example, in addition or as an alternative to the resilient member 3*a* of the conveyor 2, the guide 21 may comprise a resilient member 3*a* which is configured to urge the guide 21 towards and against the conveyor 2 as the conveyor 2 moves between the ascending and overarching portions 5, 7. As with the resilient member 3*a* of the conveyor 2, the effect of the resilient member 3*a* of the guide 21 is to urge the curved portion of the guide 21 and the conveyor 2 together. As already described in relation to the resilient member 3*a* of the conveyor 2, the resilient member 3*a* of the guide 21 may comprise a sprung and/or elastic member. A suitable material may be resilient plastics.

The force applied by the resilient means 3*a* ensures that the coins continue to be conveyed as intended. For example, if the segments 3 correspond to those described above, the resilient means 3*a* may continuously force the upstanding lugs 14 of each segment 3 against the surface of the guide plate 21 and thereby prevent the lugs 14 from skipping over the top of the coin conveyed by the segment 3. This is especially beneficial when thin, for example low denomination, coins which are more likely to slip underneath the lugs 14 are being conveyed around the path of the conveyor 2. It will be appreciated that the use of lugs is not essential and that alternative upstanding coin conveying elements configured to urge to coin along the path of the conveyor 2 during conveyor motion could alternatively be used.

In addition, or as an alternative, the force applied by the resilient means 3*a* to the segments 3 may cause the main face 13 of each segment 3 to be urged against a main surface of the coin and, in doing so, cause the coin itself to be urged against the guide plate 21 by the main face 13. An effect of this is to increase the retarding force on the coin when the conveyor 2 is stopped. Therefore, the force applied by the resilient means 3*a* can cause a corresponding braking force to be applied to the coins and thereby cause the coins to stop immediately with the conveyor 2 by friction with guide plate 21. This is particularly advantageous if there are no lugs 14 or other coin conveying elements at the front of the main face 13 which may otherwise have prevented the momentum of the coin from causing the coin to continue to slide along the guide plate 21 after the conveyor 2 has stopped.

Preventing the coins from continuing to slide along the guide plate 21 after the conveyor 2 has stopped is particularly beneficial when the coins are in the overarching portion of the conveyor 2 approaching the entrance to the coin accepting unit 6 referred to below. This is because, for the purposes of preventing a jam, it is undesirable that coins should continue to enter the accepting unit 6 after motion of the conveyor 2 and accepting unit 6 has been stopped.

As indicated above, having reached the overarching portion 7 of the conveyor 2, the coins are transferred from the conveyor 2 to the coin acceptor apparatus referred to previously. The coin acceptor apparatus comprises a coin accepting unit 6, an example of which is shown in FIG. 6. As illustrated, the coin accepting unit 6 can comprise a coin validator 6 having a substantially flat and horizontal main face 6*b* and a rotary coin transfer arm 6*c* configured to sweep coins across the main face 6*b*. The perimeter of the main face 6*b* may be bounded by an upstanding wall 6*f*. In an exemplary operation, coins deposited on the main face 6*b* at a coin entry point 6*d* can be swept across the main face 6*b* to a coin exit point 6*e* by the rotary arm 6*c*. The coin entry point 6*d* may be coupled to the overarching portion 7 of the conveyor 2, for example by a substantially vertical coin shaft which delivers coins from the overarching portion of the conveyor 2 to the coin entry point 6*d* under gravity. In this way, coins lifted to the overarching portion 7 of the conveyor 2 can be channelled or otherwise directed to the coin accepting unit 6. However the coins may be transferred to the coin accepting unit 6 without a significant fall in height, as described below.

The coin shaft may be coupled to a gap in the guide plate 21 so that coins on the underside of the segments 3 of the conveyor 2 fall into the shaft automatically upon reaching the gap in the guide plate 21. The fall can be relatively short, for example a few millimeters. In this way, the vertical position of the coin accepting unit 6 in the housing 1 can be substantially equal to the vertical position of the overarching portion 7 of the conveyor 2. Alternatively, upon reaching the gap in the guide plate 21, the coins can fall without guidance directly into the coin accepting unit 6 through the coin entry point 6*d*.

Figure 6A:
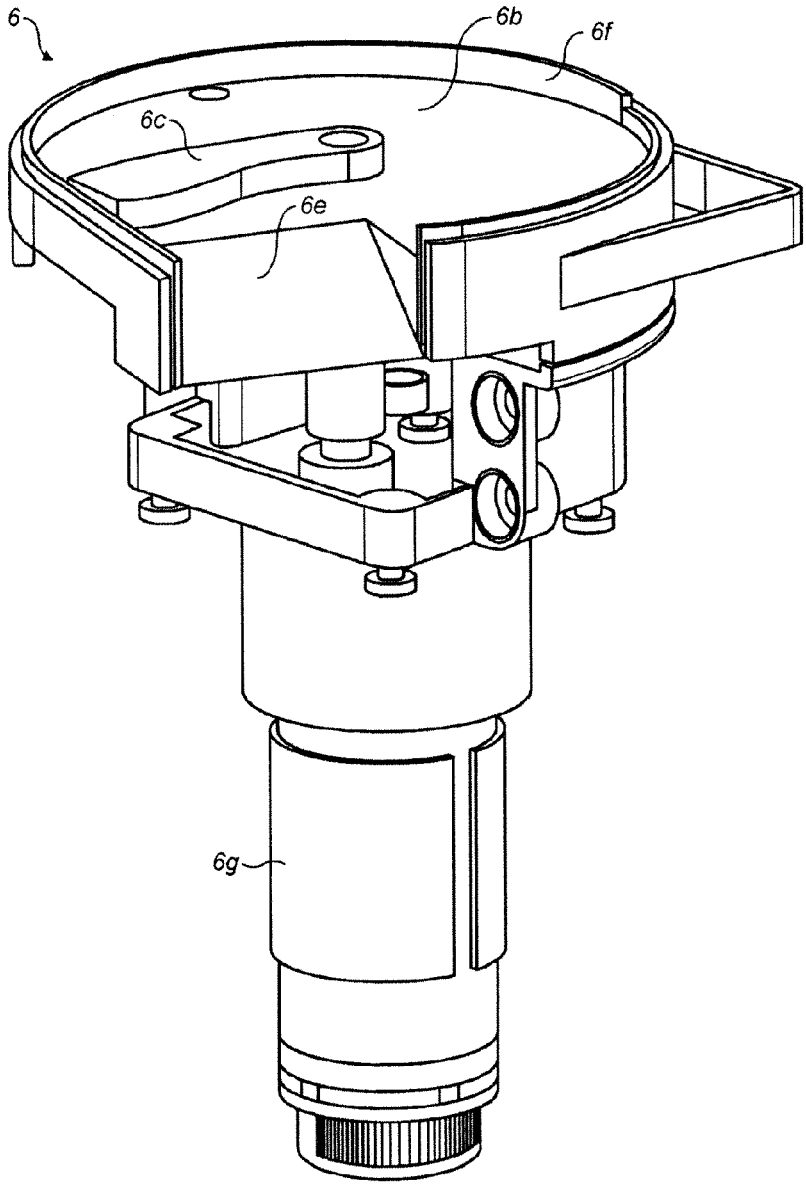
FIG. 6A is a perspective illustration of a coin acceptor unit having a rotary coin transfer arm configured to sweep across a substantially horizontal coin face.
Figure 6B:
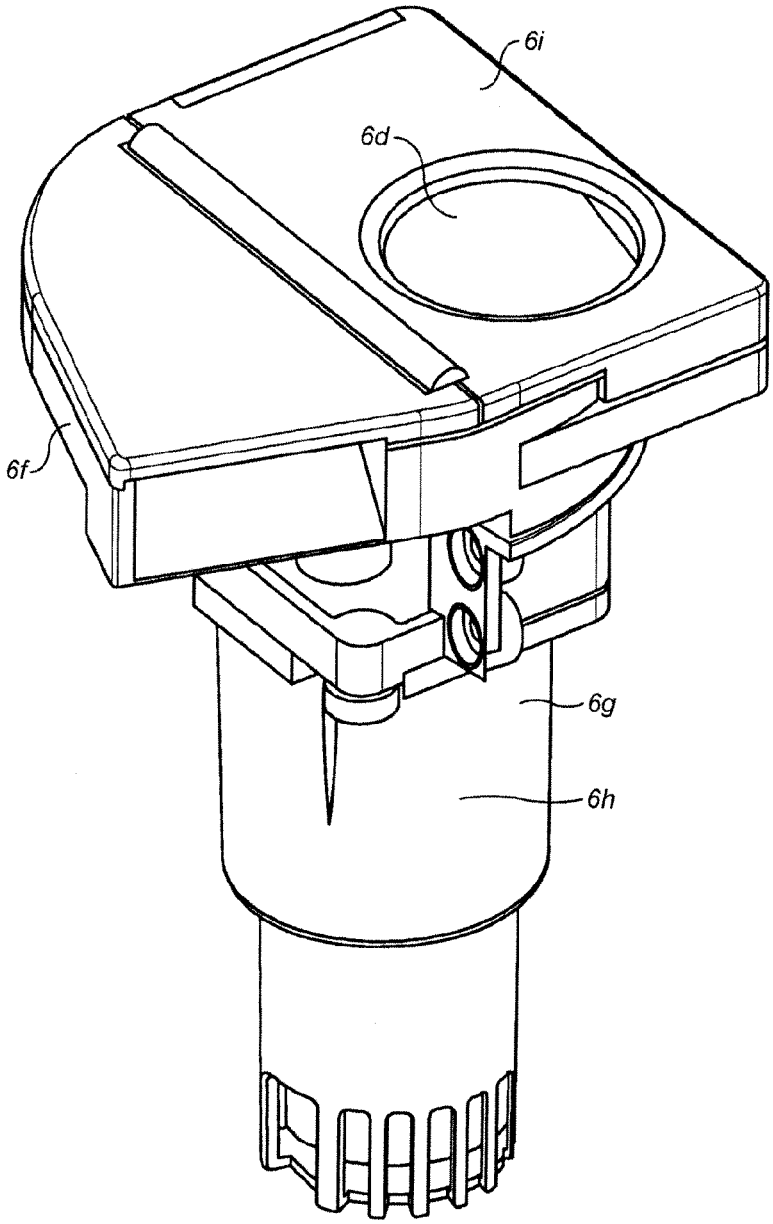
FIG. 6B is another perspective illustration of the coin acceptor unit. A cover is provided over the top of the unit.
Figure 6C:
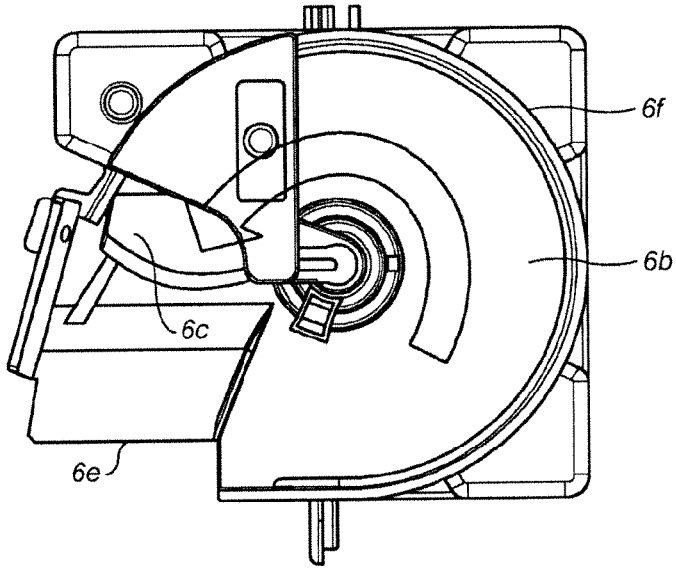
FIG. 6C is a plan illustration of the coin acceptor unit without the cover.
Figure 6D:
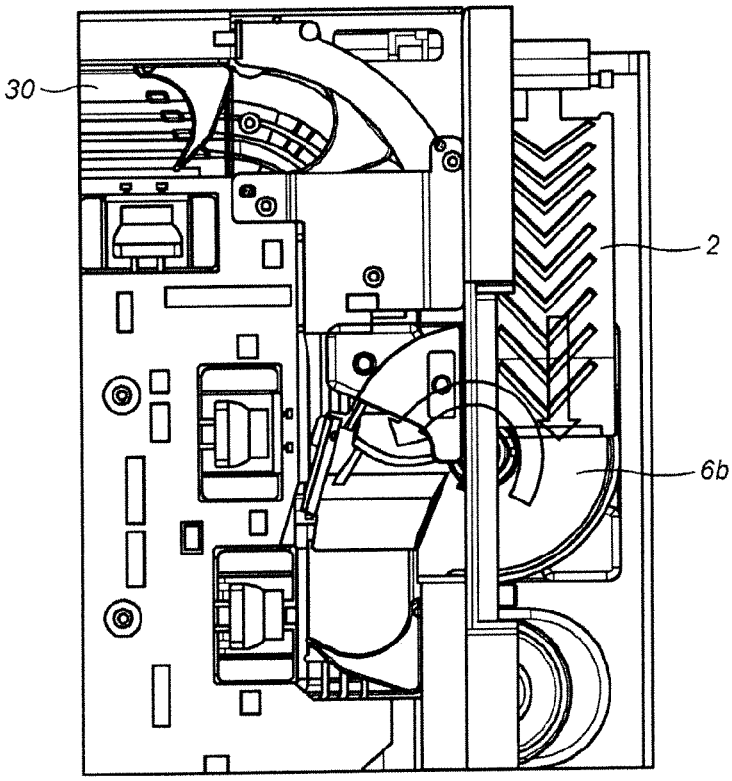
FIG. 6D is a plan illustration of the coin acceptor unit installed in a coin accepting and dispensing unit.

As shown in FIGS. 6A, 6C and 6D, the main face 6*b* of the coin accepting unit 6 can be in a substantially horizontal plane such that coin entry point 6*d* and the coin exit point 6*e* are substantially equal in height (or vertical location). The substantially horizontal main face 6*b* can, in fact, be inclined at a shallow angle such that the coin exit point 6*e* is higher or lower than the area of the main face upon which coins are deposited, meaning that coins swept by the coin arm 6*c* are pushed up or down the incline. The vertical distance between the area at which coins are deposited on the main face 6*b* and coin exit point 6*e* can, for example, compensate for any fall in coin height resulting from the transfer of the coins from the conveyor 2 to the main face 6*b* of the coin accepting unit 6. The vertical distance between the area on which the coins are deposited and the coin exit point 6*e* can, for example, be between zero and twenty-five millimeters.

The main face 6*b* of the coin accepting unit 6 can be substantially circular and the rotary coin arm 6*c* can rotate around a point which is substantially in the centre of the main face 6*b*. For example, the length of the rotary arm 6*c* may substantially match the radius of the main face 6*b*. Therefore, substantially the entire surface area of the main face 6*b* can be swept in a single rotation of the rotary arm 6*c*.

Referring to FIG. 6B, the rotary arm 6*c* can be driven by a suitable drive motor 6*g*, having a motor cover 6*h*. Optionally, the drive motor 6*g* can be positioned beneath the main face 6*b* of the accepting unit 6 so that the drive motor 6*g* can drive rotation of the rotary arm 6*c* via a drive shaft projecting through an aperture in the main face 6*b*. The rotary arm 6*c* can be mounted on the drive shaft directly above the aperture in the centre of the main face 6*b*. This is shown in FIGS. 6A and 6B.

The action of the rotary arm 6*c* may be as follows. Upon a coin being deposited on the main face 6*b* via the entry point 6*d* described above, the rotary arm 6*c* may sweep the coin across the main face 6*b* along a curved path towards the coin exit point 6*e*. The profile of the rotary arm 6*c* may be so as to guide the coin along a predictable path to the coin exit 6*e*. For example, the rotary arm 6*c* may have a trailing edge profile, so that its leading or "sweeping" face is non-perpendicular to the direction of movement of the arm 6*c*. More specifically, the angle between the direction of movement and outer portion of the arm 6*c* may be more than ninety degrees, such that the end of the arm 6*c* trails behind the portion of the arm 6*c* which is closer to the rotational centre. Coins swept by the arm 6*c* may therefore naturally slide along to the end of the arm 6*c* as the arm 6*c* rotates around the main face 6*b*. At the end of the arm 6*c* the coin will meet the perimeter of the main face 6*b*, where it may be guided by the upstanding wall 6*f* along a curved path to the exit point 6*e*.

Alternatively, the arm 6*c* may include a V-shaped profile in which the coin is trapped as it swept around the main face 6*b*. In these circumstances, the coin is held in a fixed radial position as it is moved across the main face 6*b*. The angle of the "V" may be such that the coin automatically slides into the bottom of the "V" upon the coin being initially swept-up by the coin arm 6*c*.

The leading or "sweeping" face of the coin arm 6*c* may have a chamfered profile so that the face is angled backwards from the base of the arm 6*c* to its upper surface, thereby making a non-perpendicular angle with the main surface 6*b* of the coin accepting unit 6. Therefore, if two coins have entered the coin accepting unit 6 at the same time (for any reason) and are lying on top of one another, the chamfered nature of the coin arm 6*c* can cause the upper of the two coins to slide over the top of the arm 6*c* upon first contact so that only the lower of the two coins is swept to the coin exit point 6*e*. The upper of the two coins, having slid over the top of the arm 6*c*, can be swept to the exit point 6*e* during the next rotation of the arm 6*c*.

For example, the leading face of the coin arm 6*c* may have a lower part and an upper part, the upper part being chamfered in the manner described above so as to cause stacked coins to slide over the top of the arm 6*c* rather than being forced across the main face 6*b* of the coin accepting unit 6. The lower part of the leading edge of the arm 6*c* may in contrast be substantially perpendicular to the main face 6*b* of the accepting unit 6 in order to prevent a coin lying directly on the main face 6*b* (for example at the bottom of a coin stack) from also sliding over the top of the arm 6*c*.

Optionally, as an alternative, the lower part of the leading edge of the coin arm 6*c* can chamfered in an opposite way to the upper part. Specifically, the lower part may be angled forwards from the base of the arm 6*c*, thereby making a non-perpendicular angle with the main face 6*b* of the accepting unit 6. Should the lower part of the leading face of the arm 6*c* become worn through repeated contact with coins deposited on the main surface 6*b* of the coin accepting unit 6, the lower part of the arm 6*c* will therefore tend towards being perpendicular with the main face 6*b* of the accepting unit 6. This should prevent coins lying directly on the main face 6*b* of the accepting unit 6 from sliding over the top of the arm 6*c*, even when the arm 6*c* is worn. If the lower part is chamfered in this manner, it may meet the oppositely chamfered upper part to form a point in a manner similar to the tip of a chisel.

The exit point 6*e*, as with the entry point 6*d*, may comprise a suitable opening in the upstanding wall 6*f*. Therefore, upon reaching the location of the coin exit point 6*e*, the coins may exit the accepting unit 6 by centrifugal force. Alternatively, as illustrated in FIG. 6B, the coin entry point 6*d* may comprise a suitable opening in a top cover 6*i* of the accepting unit 6. The coin exit point 6*e* can likewise comprise a suitable opening in the main face 6*b* of the accepting unit 6, for example a ramp as shown in FIG. 6A, so that coins can fall through the exit point 6*e* under gravity. The exit and entry points 6*e*, 6*d* may be aligned with the predictable curved path of the coin described above.

Once the coin has exited through the exit point 6*e*, the rotary arm 6*c* may continue to rotate back around to the coin entry point 6*d*, at which location it may collect a newly deposited coin and sweep the coin across the main face 6*b* in the same manner as described above.

The rotation of the arm 6*c* may be substantially continuous as coins are fed sequentially onto the main face 6*b* from the conveyor 2. Alternatively the rotation of the arm 6*c* may be discontinuous, for example with a pause between the locations of the coin exit point 6*e* and the coin entry point 6*d*, in order to wait for the next coin to be deposited on the main face 6*b*. For this purpose, a suitable sensor may be located at the coin entry point 6*d* to sense when coins enter the acceptor unit 6. A signal from this sensor may be sent to the microcontroller 19 to trigger rotation of the coin arm 6*c*.

The rotation of the coin arm 6*c* is controlled by the microcontroller 19, for example by sending drive signals to the drive motor mentioned above. If the rotation of the coin arm 6*c* is continuous, the microcontroller 19 can select a rotation period for the coin arm 6*c* based on a regular frequency with which coins are being delivered from the conveyor 2 to the main face 6*b* of the acceptor 6. If necessary, the frequency with which coins are being delivered to the main face 6*b* can also be adjusted, for example by slowing or intermittently stopping and restarting the conveyor 2. In this way the rotation of the coin arm 6*b* can be synchronized with the frequency with which coins are deposited on the main face 6*b*. Preferably, although the microcontroller 19 may be configured to select the operating speeds of the conveyor 2 and/or accepting unit 6 during an initialization period of the accepting and dispensing unit, the speed and rotation period of the coin arm 6*b*, together with those of the conveyor 2, are preselected at or before installation.

The accepting unit 6 may be configured to sense characteristics of the coin for coin validation purposes. For example, the microcontroller 19 can be configured to energise inductive coils 22 at different frequencies and to determine the inductive coupling with the coin during the time it is located on the main surface 6*b* of the accepting unit 6. The resulting signals can be digitized and compared by the microcontroller 19 with pre-stored values held in a memory 19A which may have associated windows around stored values, as well known in the art. The stored values are associated with known true coins and so can be used to discriminate between coins of different denominations and frauds. The inductive coils 22 can, for example, be located beneath the main surface 6*b* of the accepting unit 6 so that inductive coupling occurs as a coin is swept across the main surface 6*b* by the coin arm 6*c*.

An imaging device 20, optionally located above the main surface 6*b* or in the ascending portion 5 of the conveyor 2, may also be used to determine coin characteristics. For example, the imaging device 20 may provide two-dimensional pixelated scan data corresponding to the face of the coin being swept over the main face 6*b*. The imaging sensor 20 can provide digital image data, for example comprising colour signals to detect features of bimetal coins that present faces with regions of different colours, to the microcontroller 19. The microcontroller 19 may then run an algorithm to convert the image data signals into signals corresponding to an image of the coin in a predetermined orientation. The resulting signals can be then compared with reference data held in the memory 19A connected to the microcontroller 19. One example of an algorithm for orienting the data is described in EP-A-1834306.

The diameter of the coins can be measured by detecting the leading and trailing edges of the coins as they are swept over the main surface 6*b* of the accepting unit 6. For example the imaging device 20 or alternative optical and/or magnetic sensors may detect the leading and trailing edges of the coin as it is swept over a predetermined location on the predictable curved coin path described above. The time elapsed between detection of the leading and trailing edges of the coin, together with a known speed of the coin at the location on the coin path, can be used to determine coin diameter.

Consequently, the microcontroller 19 can use the outcome of the inductive testing, and/or the outcome of comparison data derived from the coin image device 20 and/or the diameter of the coin to determine the denomination and authenticity of individual coins that pass through the sensing station 6 on the individual conveyor segments 3. Thus, the microprocessor 19 can derive data corresponding to the denomination of the coins moving along the conveyor 2 and can associate this information with the segment identity data derived by the sensor 18 in the ascending portion 5 of the conveyor 2.

From the coin exit point 6*e* the coins enter the sorting and distributing system previously referred to, in which they can take one of three routes. Firstly, if the coin has been determined as invalid or fraudulent in the coin accepting unit 6, the coin is returned to the user via an exit shoot. For example, upon the coin being detected as invalid, the coin may be returned to the user via an exit shoot leading to an exterior of the housing 1. Secondly, if the coin is determined as valid in the accepting unit 6, the coin can be fed to one of a plurality of coin hoppers 24*a*, 24*b*, 24*c* for recycling. For example, the coin may be used to provide change or a payout to the user. This is described in more detail below. Lastly, if the coin is determined as valid but is not to be recycled, for example because the coin hoppers 24 referred to above are full, then it is diverted to a secure storage unit in the housing 1 for safekeeping. The secure storage unit can comprise a cash box, which can be accessed by an authorised person for emptying at an appropriate time. A coin diverter (not shown) positioned adjacent the coin exit point 6*e* of the accepting unit 6 may channel the coins along the three routes described above in dependence of a signal from the microcontroller 19.

Figure 7B:
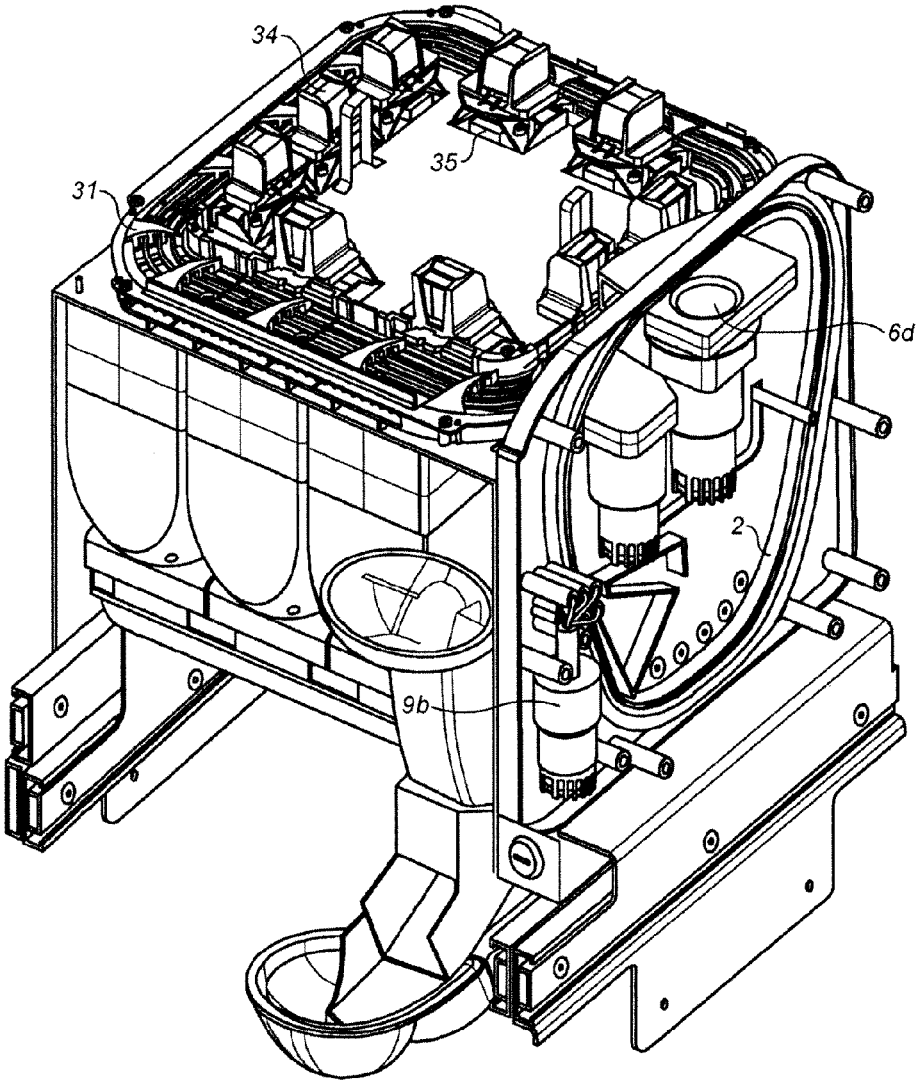
FIG. 7B is a perspective illustration of a coin accepting and dispensing unit having coin conveyors in both a substantially vertical plane and a substantially horizontal plane.

If the second route is chosen, the coins are deposited either directly from the coin exit point 6*e* or via a coin channel to a second coin conveyor 30. A gravity feed can be used, such as the ramp shown in FIG. 6A. However, the vertical location at which coins are deposited onto the second conveyor 30 can be substantially equal to the vertical location at which coins exit the first conveyor 2. The inclined main face 6*b* of the coin accepting unit 6 referred to above can be used. The fall from the coin accepting unit 6 to the second conveyor 30 is short, for example less than twenty millimeters, so that the vertical location at which coins are deposited on the second conveyor 30 is similar to that of the exit point 6*e* in the accepting unit 6. The second coin conveyor 30 may be a carousel conveyor 30 which conveys coins in a substantially horizontal plane from the exit 6*e* of the coin acceptor 6 to one of a plurality of coin storage hoppers 24. For example, referring to FIGS. 7A and 7B, the second coin conveyor 30 can comprise a substantially horizontal endless loop conveyor 30 configured to transfer coins to the plurality of coin hoppers 24 in which the coins can be securely stored and, subsequently, from which the coins can be dispensed to users as a payout or as change. The substantially horizontal plane of the second coin conveyor 30 can be substantially parallel to that of the main face 6*b* of the coin accepting unit 6 described above, and can be substantially perpendicular to the substantially vertical plane of the coin conveyor 2 initially described.

The plane of the second coin conveyor 30 can, in fact, be inclined at a shallow angle such that the vertical location of coins circulating around the conveyor increases or decreases slightly from the vertical location at which the coins were deposited in the conveyor 30 from the coin accepting unit 6. The incline of the second conveyor 30 can, for example, compensate for any fall in coin height resulting from the transfer of the coins from the first conveyor 2 to the main face 6*b* of the coin accepting unit 6, or from the main face 6*b* of the coin accepting unit 6 to the second conveyor 30. The vertical distance between the highest and lowest points of the second conveyor 30 can, for example, be between zero and twenty-five millimeters.

The carousel conveyor 30 is coupled to the plurality of coin hoppers 24, for example six, seven or eight hoppers 24, via a series of gates 33 positioned at regularly spaced intervals on the conveyor 30. The hoppers 24 may for example each comprise a Compact Hopper as manufactured by Money Controls PLC. The coin hoppers 24 may be positioned beneath the horizontal conveyor 30 and adjacent the vertical conveyor 2 so that the hoppers 24 are bounded by the conveyors 2, 30. The position of the hoppers 24 and conveyors 2, 30, together with the coin accepting unit 6, provides the overall accepting and dispensing unit with a very compact configuration and there is little wasted space in the housing 1. This may allow the size of the housing 1 to be reduced compared to previous units.

The coin gates 33 in the conveyor 30 can be opened under the control of the microcontroller 19 to allow the coins to selectively fall under gravity into a particular one of the hoppers 24, thereby allowing the coins to be sorted into different types. The decision to open a particular coin gate 33 is based on the known location of a known coin. For example, a coin deposited on the conveyor 30 from the coin accepting unit 6 has a known denomination and its position relative to the coin gates 33 is tracked by the microcontroller 19 based on the known speed of the conveyor and on the particular known section of the conveyor 30 onto which the coin was deposited. The microcontroller can therefore make an active, intelligent decision to determine which of the plurality of coin hoppers 24 the coin should be sent to, and accordingly open the correct gate and divert the coin into the hopper 24 when the coin is at the correct position on the conveyor 30. Each hopper 24 may, for instance, collect coins of only a particular denomination. This is schematically illustrated in FIG. 1. The coins can be deflected into the gates 33 by a deflecting means such as sprung actuator or a rigid pin which can be moved into the path of the coin as required to divert the coin into the gate 33.

In more detail, the carousel conveyor 30 may comprise a plurality of equally spaced coin conveying elements 31, which may be driven around the path of the conveyor 2 by the motor 11 referred to previously or a separate drive means. A gearing system may be used such that the speed of the two conveyors 2, 30 can be independently controlled even though they are driven by the same motor 11. The space between neighbouring elements 31 can be sufficient to accommodate any conventionally sized coin. Each conveying element 31 may comprise at least one upstanding element, such as one or more lugs or an upstanding wall, which is configured to apply a lateral force to the coin as the element 31 circulates around the track. Coins deposited on the conveyor 30 from the coin accepting unit 6 are therefore pushed around the carousel 30 by the conveying elements 31. Each coin conveying element 31 may be provided with an individual code to allow the exact position of the coin conveying element 31 in relation to the conveyor loop 30 to be continuously monitored by the microcontroller 19 as it circulates. The individual code can for example be a magnetic code, although other coding arrangements such as RFID or optical bar-coding can alternatively be used.

Figure 8A:
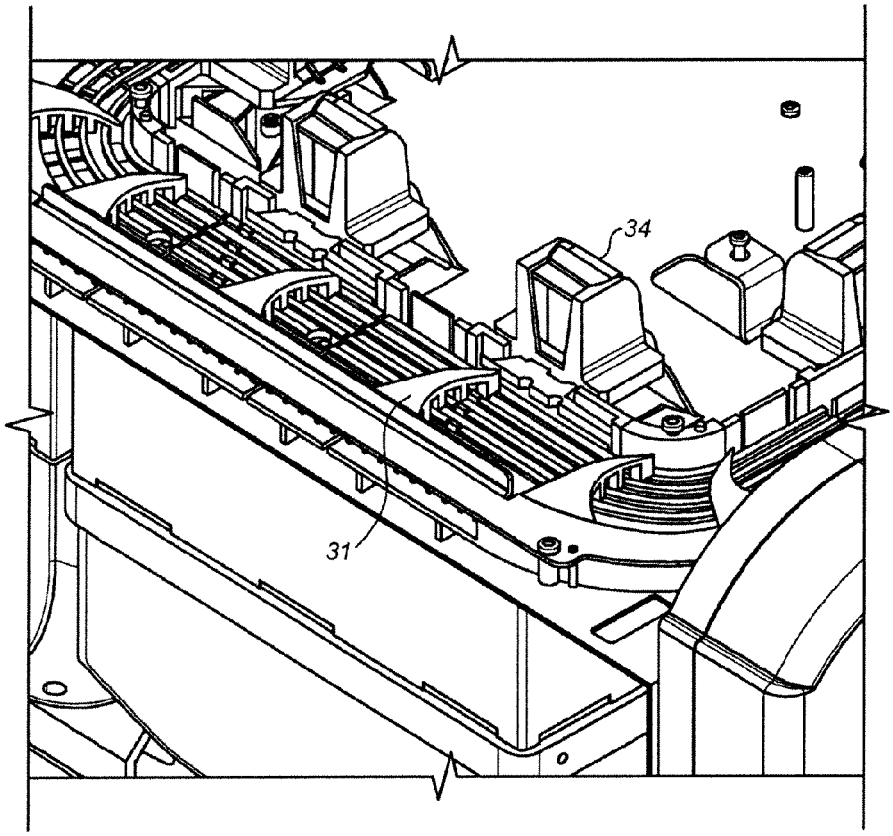
FIG. 8A is a perspective illustration of a section of track on a carousel coin conveyor.

In the example shown in FIG. 8A, the conveyor 30 comprises a substantially horizontal looped coin track 32. This is described below. However, the conveyor 30 may alternatively be of a different type. For example, the conveyor 30 can comprise a rotating disc or ring on which the conveying elements 31 are positioned. The conveying elements 31 may be equally spaced around the disc or ring's circumference. Coins can be selectively deflected off the disc or ring by a diverting means in the manner described above.

The looped conveying track 32 may comprise a plurality of substantially parallel fingers, or rails, which are aligned with the direction of the track 32 and therefore follow the looped path of the endless conveyor 30. The coin conveying elements 31 may be engaged with the fingers or rails such that they continuously circulate around the conveyor 30, always being guided along the direction of the track.

Figure 8B:
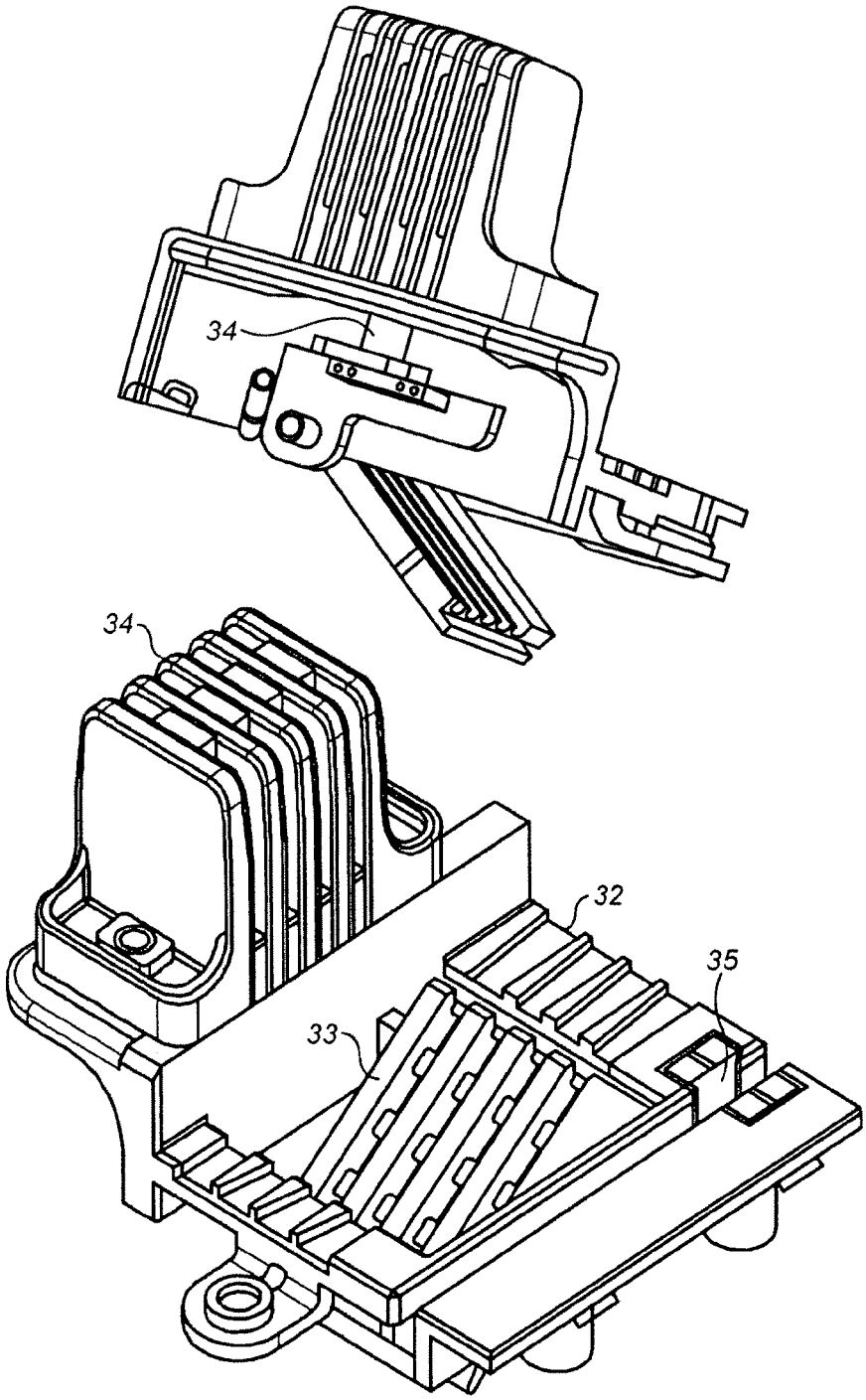
FIG. 8B is a perspective illustration of a coin gate in the track and an accompanying solenoid.

The gates 33 may comprise individual sections of the track 32 which can be lifted about a pivot point in the manner of a drawbridge. A solenoid 34, optionally protected by a cover, is located adjacent to each gate 33 and can be selectively activated by the microcontroller 19 to open and close the gate 33 as and when required. When the gate 33 is opened, a gap is left in the track 32 through which coins can fall through a suitable channel into the connected hopper 24 below. The gate 33 can then be immediately closed to allow the conveying element 31 which pushed to coin into the hopper 24 to slide over the gate 33 and continue to circulate around the track 32. In an alternative implementation, a trap door type gate 33 can be used instead of a drawbridge. This is illustrated in FIG. 8B. In a further alternative, the gate 33 is adjacent to the track 32 and coins are diverted off the track 32 into the gates 33 using the diverting means described previously.

In this manner, by setting the speed at which the coin conveying elements 31 are driven around the conveyor 30, the microcontroller 19 is able to determine exactly when to open different gates 33 in order to divert each individual coin into the correct coin hopper 24. This is because the microcontroller 19 is aware of the denomination of each coin exiting the coin accepting unit 6 and, knowing the time at which the coin exited the coin accepting unit 6, can determine the particular coin conveying element 31 which is pushing or carrying the coin. The precise location of each coin conveying element 31 is also known, since each conveying element is associated with an RFID label, magnet or other suitable means which allows the position of the element 31 to be tracked. Using this information, the microcontroller 19 can accurately calculate the time at which the coin will be conveyed to the appropriate gate 33. In addition, optical or other suitable sensors 35 may be located in the track 32 at locations immediately preceding each gate 33 so that the coins being driven around the carousel 30 are detected as they approach the gates 33. The optical sensors 35 may send a detection signal to microcontroller 19 as a further measure for ensuring that the microcontroller 19 opens and closes the gates 33 at the correct time.

The tracking of the coin locations on the conveyor 30 therefore allows the microcontroller 19 to make the intelligent coin sorting decisions referred to previously. The data is continuously stored in the memory 19A so that, in the event of a power failure or unforeseen shutdown, the positions of the coins on the conveyor 30 can be recovered. This enables a largely seamless restart of the unit.

By this process, the hoppers 24 accumulate acceptable coins of individual denominations or groups of denominations and can be used to provide change during the purchasing transaction. As described in our EP-A-1560168 the microcontroller 19 may receive information concerning the value of an article to be purchased or a game to be played and can compute the monetary value of coins accepted in response to a purchasing transaction by the coin accepting unit 6, and from this information compute the change required. The microcontroller 19 then instructs the appropriate hopper(s) 24 to pay out an appropriate combination of coins to provide the change, which fall onto a path 25 that may comprise a conveyor or a gravity feed, to provide the change to the user at an outlet 26. The outlet 26 may be below the coin inlet in the housing 1 but can be closely spaced to it because the coins do not need to fall by gravity through the accepting and dispensing unit. Instead they are conveyed through the unit by the conveyor 2. Furthermore, in a modification, the coin inlet may be at the same level as the coin outlet 26 as illustrated by inlet 9' in FIG. 1A.

Figure 9:
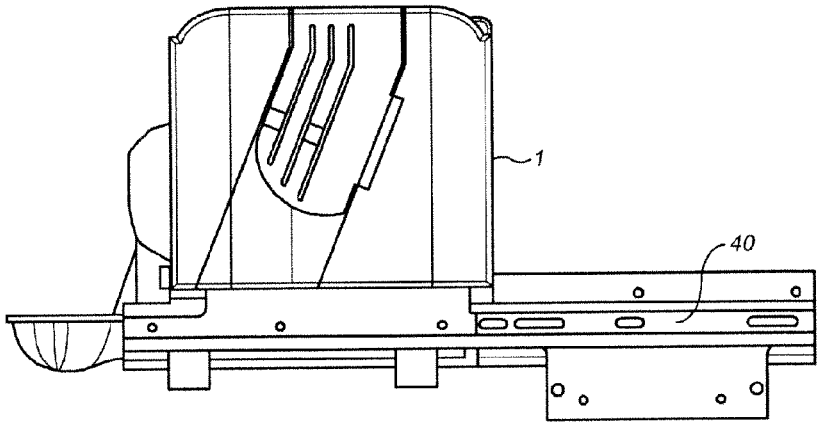
FIGS. 9 and 10 are illustrations of a housing containing one more coin hoppers. Both the housing and coin hoppers have been slid out from a first position to a second position on rails.
Figure 10:
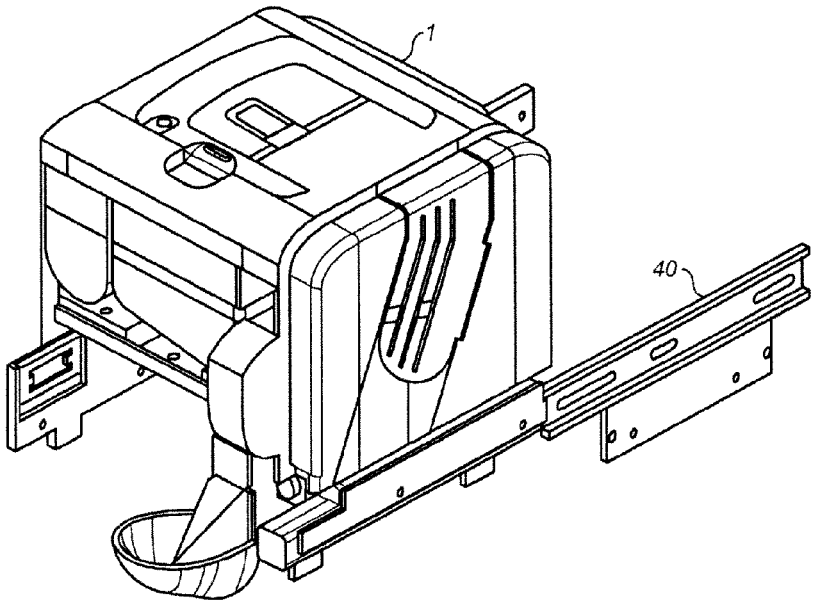

Referring to FIGS. 9 to 10, the accepting and dispensing unit as a whole can be mounted inside a larger unit (not shown) such as a vending or gaming machine.

The housing 1, in which are mounted the conveyors 2, 30, coin accepting unit 6 and various other elements of the accepting and dispensing unit, can be mounted on rails 40 which can be securely fixed to a chassis or housing of the larger unit. This allows the housing 1 to be slid out from the larger unit and therefore facilitates easier maintenance of the unit by a service person.

Both of the housing 1 and the coin hoppers 24 present a significant cantilever load when slid out from the larger unit. This is especially true of the coin hoppers 24 when they are loaded with coins. The cantilever load causes significant stress to be placed on the rails, which must be designed to have a strength which is sufficient to withstand the load. The cantilever load also significantly reduces the stability of the larger unit, and may cause it to topple over unless sufficient precautions are taken. Therefore, it is desirable to keep the cantilever load as low as possible.

Figure 11:
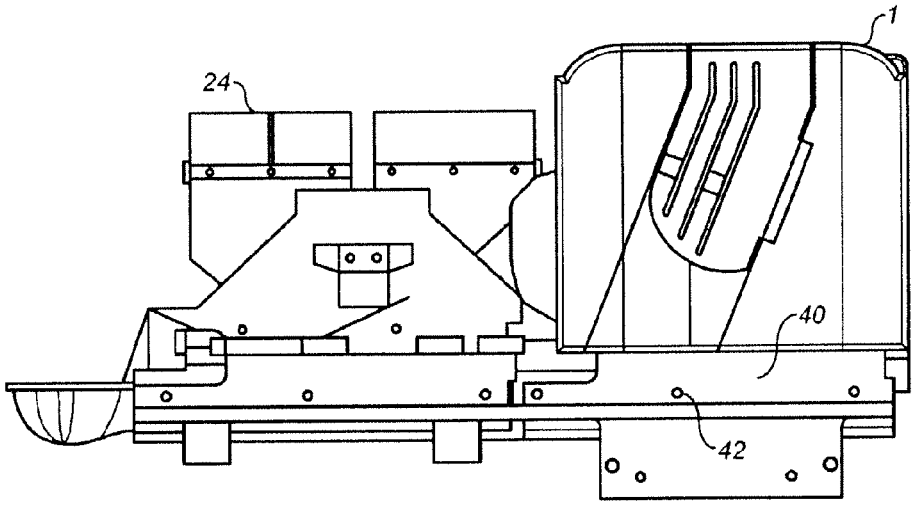
FIGS. 11 and 12 are illustrations of one or more coin hoppers having been slid out to a second position on rails from a first position in a housing.
Figure 12:
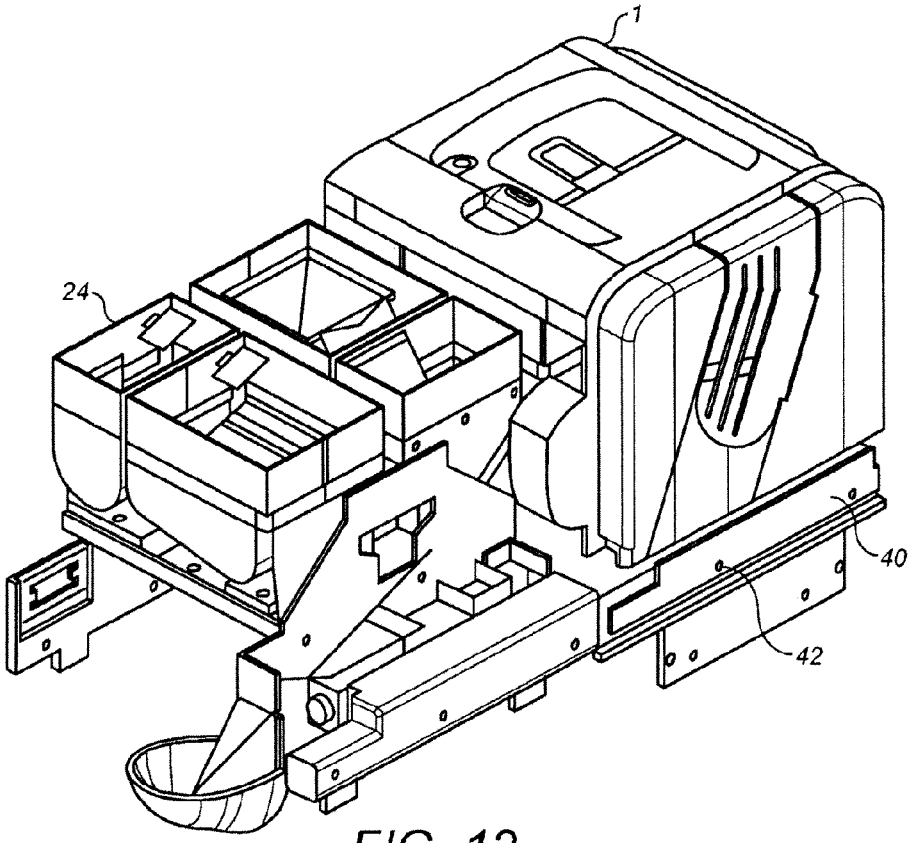

This is achieved by making the hoppers 24 independently slideable from the housing 1 and the rest of the accepting and dispensing unit, so that when the hoppers 24 are loaded with coins they can be safely slid out from the larger unit without the remaining elements of the accepting and dispensing unit. Referring to FIGS. 11 and 12, in a similar manner to that described above, the coin hopper 24 can be mounted on the rails 40 independently of the housing 1 and remaining unit elements. Alternatively the coin hoppers 24 can be mounted on their own separate rails, also securely fixed to the chassis.

A weight sensor 41 may continuously monitor the weight of the coin hoppers 24 such that when the coin hoppers 24 exceed a particular threshold weight, they can no longer be slid out from the larger unit together with the remaining elements of the accepting and dispensing unit. For example, an automatic locking means 42 may be incorporated into the mounting with the rails 40 such that when one of the housing 1 or hopper 24 is slid outwards from its normal position in the larger unit, the other of the housing 1 or hoppers 24 cannot be moved. The locking means 42 may be actuated in response to a signal from the microcontroller 19, which in turn is configured to receive signals from the weight sensor 41.

Many modifications and variations falling within the scope of the following claims will be evident to those skilled in the art. For example, the coin singular apparatus can instead lie in a substantially horizontal plane so that it feeds coins inserted through the coin inlet 9 directly into the coin acceptor apparatus. In this case, the substantially horizontal planes of the coin singulating apparatus, coin acceptor apparatus and coin sorting and distributing apparatus may have substantially the same vertical location in the housing 1 of the accepting and dispensing unit. The coin flow is therefore broadly in the same horizontal plane through all three sections of the unit.

The invention claimed is:

1. An apparatus comprising:

a coin sensing unit having a substantially horizontal main face upon which coins can be deposited, a coin sweeping arm configured to rotate in a substantially horizontal plane so as to sweep coins across the main face, and a coin sensing apparatus configured to sense characteristics of a coin as it is swept across the main face;

a coin conveyor configured to receive coins from a coin exit of the coin sensing unit and to convey the coins in a substantially horizontal plane;

a rotary coin conveyor in a substantially vertical plane configured to convey coins from a first lower position to a second higher position;

wherein the coin sensing unit is configured to receive coins from the substantially vertical coin conveyor at the second higher position; and wherein the substantially horizontal coin conveyor is configured to convey the coins to one of a plurality of coin hoppers located beneath the substantially horizontal plane of the coin conveyor.

2. An apparatus according to claim 1, wherein the main face of the coin sensing unit is substantially circular and the length of the sweeping arm is substantially equal to the radius of the main face.

3. An apparatus according to claim 1, wherein a leading face of the sweeping arm comprises a "V" profile in which coins are held in a fixed position relative to the sweeping arm and thus swept across the main face along a predictable path.

4. An apparatus according to claim 1, wherein the sensing unit is configured to cause a comparison between sensed characteristics of the coin and known genuine coin characteristics in order to validate the coin.

5. An apparatus according to claim 1, wherein the coin conveyor is configured to receive coins from the coin sensing unit and to convey the coins to one of a plurality of coin hoppers.

6. An apparatus according to claim 1, wherein the coin conveyor comprises a rotary conveyor configured to convey the coins along a looped path in said substantially horizontal plane.

7. An apparatus according to claim 1, wherein the coin conveyor comprises a plurality of individually controllable gates which are configured to open in response to an opening signal to selectively cause one or more coins being conveyed on the conveyor to fall into a selected one of a plurality of coin hoppers.

8. An apparatus according to claim 7, wherein each gate is connected to at least one hopper and wherein the gate which is opened for each particular coin is selected in response to a signal indicating sensed characteristics of the coin, thereby causing the coin to fall into the hopper connected to the opened gate.

9. An apparatus according to claim 7, wherein a solenoid is located adjacent to each gate to cause the gate to open or close in response to an opening or closing signal.

10. An apparatus according to claim 1, wherein the horizontal planes of the coin sensing unit and horizontal coin conveyor are at substantially the same vertical height.

11. An apparatus according to claim 1, wherein the substantially vertical coin conveyor is configured to convey coins along a substantially curved portion of a guide into a substantially horizontal plane on a substantially horizontal portion of the guide.

12. An apparatus according to claim 11, wherein the substantially vertical conveyor comprises a chain of coin conveying elements configured to convey coins along the guide.

13. An apparatus according to claim 11, configured to feed coins in a horizontal plane from the horizontal portion of the guide onto the main face of the coin sensing unit.

14. An apparatus according to claim 11, wherein the horizontal planes of the coin sensing unit, the horizontal coin conveyor and the guide are at substantially the same vertical height.

15. An apparatus according to claim 11, wherein the substantially vertical conveyor is configured to receive coins at the first lower position on an upper side of the conveyor and to convey the coins along the curved portion of guide until the coins are disposed on a lower side of the conveyor between the conveyor and the guide.

16. An apparatus according to claim 11, wherein the guide is static relative to the substantially vertical conveyor.

17. An apparatus for mounting in a gaming or vending or self-operated payment machine, comprising:

a coin sensing unit having a substantially horizontal main face upon which coins can be deposited, a coin sweeping arm configured to rotate in a substantially horizontal plane so as to sweep coins across the main face, and a coin sensing apparatus configured to sense characteristics of a coin as it is swept across the main face;

a coin conveyor configured to receive coins from a coin exit of the coin sensing unit and to convey the coins in a substantially horizontal plane;

at least one coin hopper having a first normal position;

at least one other component having a first normal position corresponding to the first normal position of the coin hopper; and a slider mountable to the machine for sliding the at least one coin hopper and the at least one other component out of the gaming or vending machine to a second outward position;

wherein the at least one coin hopper can be slid independently of the at least one other component.

18. An apparatus according to claim 17, comprising:

a sensor for sensing the weight of the at least one coin hopper; and a lock configured to prevent the at least one coin hopper from leaving the first normal position when the at least one other component is not in its first normal position if the weight of the at least one hopper exceeds a predetermined value.

19. An apparatus according to claim 17, wherein the at least one other component comprises a housing in which the at least one coin hopper is located in the first position during normal operation of the apparatus in the machine.

20. An apparatus according to claim 17, wherein the main face of the coin sensing unit is substantially circular and the length of the sweeping arm is substantially equal to the radius of the main face.

21. An apparatus according to claim 17, wherein a leading face of the sweeping arm comprises a "V" profile in which coins are held in a fixed position relative to the sweeping arm and thus swept across the main face along a predictable path.

22. An apparatus according to claim 17, wherein the sensing unit is configured to cause a comparison between sensed characteristics of the coin and known genuine coin characteristics in order to validate the coin.

23. An apparatus according to claim 17, wherein the coin conveyor is configured to receive coins from the coin sensing unit and to convey the coins to one of a plurality of coin hoppers.

24. An apparatus according to claim 17, wherein the coin conveyor comprises a rotary conveyor configured to convey the coins along a looped path in said substantially horizontal plane.

25. An apparatus according to claim 17, wherein the coin conveyor comprises a plurality of individually controllable gates which are configured to open in response to an opening signal to selectively cause one or more coins being conveyed on the conveyor to fall into a selected one of a plurality of coin hoppers.

26. An apparatus according to claim 25, wherein each gate is connected to at least one hopper and wherein the gate which is opened for each particular coin is selected in response to a signal indicating sensed characteristics of the coin, thereby causing the coin to fall into the hopper connected to the opened gate.

27. An apparatus according to claim 25, wherein a solenoid is located adjacent to each gate to cause the gate to open or close in response to an opening or closing signal.

28. An apparatus according to claim 17, wherein the horizontal planes of the coin sensing unit and horizontal coin conveyor are at substantially the same vertical height.

* * * * *